US011232764B2

(12) United States Patent
Masai

(10) Patent No.: US 11,232,764 B2
(45) Date of Patent: Jan. 25, 2022

(54) DISPLAY DRIVER AND DISPLAY DEVICE

(71) Applicant: LAPIS Semiconductor Co., Ltd., Yokohama (JP)

(72) Inventor: Hideki Masai, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 0 days.

(21) Appl. No.: 17/064,077

(22) Filed: Oct. 6, 2020

(65) Prior Publication Data

US 2021/0104204 A1 Apr. 8, 2021

(30) Foreign Application Priority Data

Oct. 8, 2019 (JP) ..... JP2019-185146

(51) Int. Cl.
*G09G 3/36* (2006.01)

(52) U.S. Cl.
CPC ..... *G09G 3/3696* (2013.01); *G09G 3/3677* (2013.01); *G09G 3/3688* (2013.01); *G09G 2310/0243* (2013.01); *G09G 2310/08* (2013.01); *G09G 2320/10* (2013.01)

(58) Field of Classification Search
CPC .. G09G 3/3696; G09G 3/3677; G09G 3/3688; G09G 2320/10; G09G 2310/0243; G09G 2310/08; G09G 2340/0435; G09G 3/3607; G09G 3/3611; G09G 3/38; G09G 2320/0271
See application file for complete search history.

(56) References Cited

U.S. PATENT DOCUMENTS 6,219,020 B1 * 4/2001 Furuhashi ..... G09G 3/3611 345/100
7,307,613 B2 * 12/2007 Teshirogi ..... G09G 3/3611 345/204
9,024,859 B2 * 5/2015 Park ..... G06F 3/038 345/100
9,767,761 B2 * 9/2017 Shiibayashi ..... G09G 3/3688
10,621,943 B2 * 4/2020 Higuchi ..... G09G 3/3674
2004/0012583 A1 * 1/2004 Teshirogi ..... G09G 3/3611 345/204
2011/0142162 A1 * 6/2011 Shih ..... H04L 25/05 375/295

(Continued)

FOREIGN PATENT DOCUMENTS

JP 2006-295588 A 10/2006

*Primary Examiner* — Michael J Jansen, II
(74) *Attorney, Agent, or Firm* — Rabin & Berdo, P.C.

(57) ABSTRACT

A first latch retrieves a pixel data piece for each one horizontal scanning period of a video data signal and holds the pixel data piece as a first pixel data piece. A second latch retrieves the first pixel data piece from the first latch at a timing when the retrieval by the first latch is completed and holds the first pixel data piece as a second pixel data piece. An interpolation data generating unit obtains the first pixel data piece and the second pixel data piece and generates an interpolation data piece. A third latch alternately performs a retrieval of the second pixel data piece and a retrieval of the interpolation data piece, and sequentially outputs the retrieved data piece as a third pixel data piece. A gradation voltage output unit outputs the gradation voltage signal based on the third pixel data piece.

5 Claims, 7 Drawing Sheets

(56) References Cited

U.S. PATENT DOCUMENTS

| | | | | |
|---|---|---|---|---|
| 2013/0286003 | A1* | 10/2013 | Park | G09G 3/3685 345/214 |
| 2016/0071479 | A1* | 3/2016 | Shiibayashi | G09G 3/3688 345/212 |
| 2017/0011703 | A1* | 1/2017 | Higuchi | G09G 3/3674 |

* cited by examiner

DISPLAY DRIVER AND DISPLAY DEVICE

CROSS-REFERENCE TO RELATED APPLICATION

This application is based upon and claims the benefit of priority from the prior Japanese Patent Application No. 2019-185146 filed on Oct. 8, 2019, the entire contents of which are incorporated herein by reference.

BACKGROUND

1. Technical Field

The present invention relates to a display driver and a display device.

2. Description of the Related Art

While a display device that supports, what is called, 4K (for example, 3840×2160 pixels) resolution is gaining popularity these days, video content that supports 4K is not sufficient. In view of this, when a conventional high-definition broadcast is watched on the display device supporting 4K, for example, a converter, such as an upscan converter, is externally coupled to the display device and a frequency of a video signal is converted for watching.

The video signal transmitted in ordinary digital broadcasting employs an interlace system. Accordingly, a conversion process of the video signal has to be performed to watch an ordinary digital broadcast on a display device supporting a progressive system. Therefore, there has been proposed a video signal processing device that performs a process that converts a video signal so as to display horizontal scanning lines for two lines with a video signal for one horizontal scanning line by changing a timing of a gate clock signal (for example, JP-A-2006-295588).

In case where, without sufficient video content supporting 8K (for example, 7680×4320 pixels), which is high in image quality exceeding a high-definition and 4K, display devices supporting 8K gain popularity in the future, similarly, it is expected that the converter or the like is externally coupled to the display device to convert the video signal.

SUMMARY

As described above, for example, when a 4K television broadcast is watched on a display device supporting 8K, a performance of the display device supporting 8K cannot be sufficiently utilized unless a user purchases a converter or the like and couples it to the display device. In view of this, there has been a problem of increased scale and cost of the device.

Since an 8K video signal has an encoding system of 10 bits and a frame frequency of 120 Hz, an information volume is extremely large compared with a high-definition broadcast and a 4K broadcast. Converting the video signal using the above-described converter or the like accelerates a communication speed in association with an increased information volume. Therefore, there has been a problem that a communication waveform is degraded to generate a failure in data transmission from a timing controller (T-CON) to a PCB substrate of a large-sized panel.

The present invention has been made in consideration of the above-described problems, and it is an objective to provide a source driver that ensures displaying a video to which pixels are interpolated while reducing an increase in scale of a device and a degradation of a communication waveform caused by an addition of an external device.

A display driver according to the present invention is A display driver coupled to a display panel, wherein the display panel includes m data lines and n gate lines (m and n are integers of two or more), and m×n pixel portions disposed in a matrix at respective intersecting portions between the m data lines and the n gate lines, and the display driver receives a video data signal for one frame and generates a gradation voltage signal, the video data signal being formed of continuous n/2 pieces of pixel data piece groups each of which is formed of m pixel data pieces, the gradation voltage signal being supplied to each of the m×n pixel portions based on the video data signal, wherein the display driver comprises m output circuits disposed corresponding to the m data lines, the m output circuits outputting the gradation voltage signal to each of the m data lines, wherein each of the m output circuits includes: a first latch that sequentially retrieves the pixel data piece from the pixel data piece group for each one horizontal scanning period of the video data signal, the first latch holding the pixel data piece as a first pixel data piece; a second latch that retrieves the first pixel data piece from the first latch at a timing when the retrieval of the pixel data piece by the first latch is completed, the second latch holding the first pixel data piece as a second pixel data piece; an interpolation data generating unit that obtains the first pixel data piece from the first latch and obtains the second pixel data piece from the second latch so as to generate an interpolation data piece by interpolating between the first pixel data piece and the second pixel data piece; a third latch that alternately performs a retrieval of the second pixel data piece from the second latch and a retrieval of the interpolation data piece from the interpolation data generating unit, the third latch sequentially outputting the second pixel data piece and the interpolation data piece as a third pixel data piece; and a gradation voltage output unit that outputs a gradation voltage signal corresponding to the third pixel data piece based on the third pixel data piece output from the third latch.

A display device according to the present invention A display device comprising: a display panel including m data lines, n gate lines (m and n are integers of two or more), and m×n pixel portions disposed in a matrix at respective intersecting portions between the m data lines and the n gate lines; a gate driver that supplies a scan signal that controls to turn on a pixel switch in a selection period corresponding to a pulse width to the n gate lines; a data driver that receives a video data signal for one frame, and generates a gradation voltage signal, the video data signal being formed of continuous n/2 pieces of pixel data piece groups each of which is formed of m pixel data pieces, the gradation voltage signal being supplied to each of the m×n pixel portions based on the video data signal; and a display controller that supplies the video data signal to the data driver, wherein the data driver includes m output circuits disposed corresponding to the m data lines, the m output circuits outputting the gradation voltage signal to each of the m data lines, and each of the m output circuits includes: a first latch that sequentially retrieves the pixel data piece from the pixel data piece group for each one horizontal scanning period of the video data signal, the first latch holding the pixel data piece as a first pixel data piece; a second latch that retrieves the first pixel data piece from the first latch at a timing when the retrieval of the pixel data piece by the first latch is completed, the second latch holding the first pixel data piece as a second pixel data piece; an interpolation data generating unit that obtains the first pixel data piece from the first latch and obtains the second pixel data piece from the second latch so as to generate an interpolation data piece by interpolating between the first pixel data piece and the second pixel data piece; a third latch that alternately performs a retrieval of the second pixel data piece from the second latch and a retrieval of the interpolation data piece from the interpolation data generating unit, the third latch sequentially outputting the second pixel data piece and the interpolation data piece as a third pixel data piece; and a gradation voltage output unit that outputs a gradation voltage signal corresponding to the third pixel data piece based on the third pixel data piece output from the third latch.

The display driver according to the present invention ensures displaying a video to which pixels are interpolated while reducing an increase in scale of a device and a degradation of a communication waveform caused by an addition of an external device.

BRIEF DESCRIPTION OF THE DRAWINGS

Features of the present invention will be described below with reference to the accompanying drawings.

DETAILED DESCRIPTION

Figure 1:
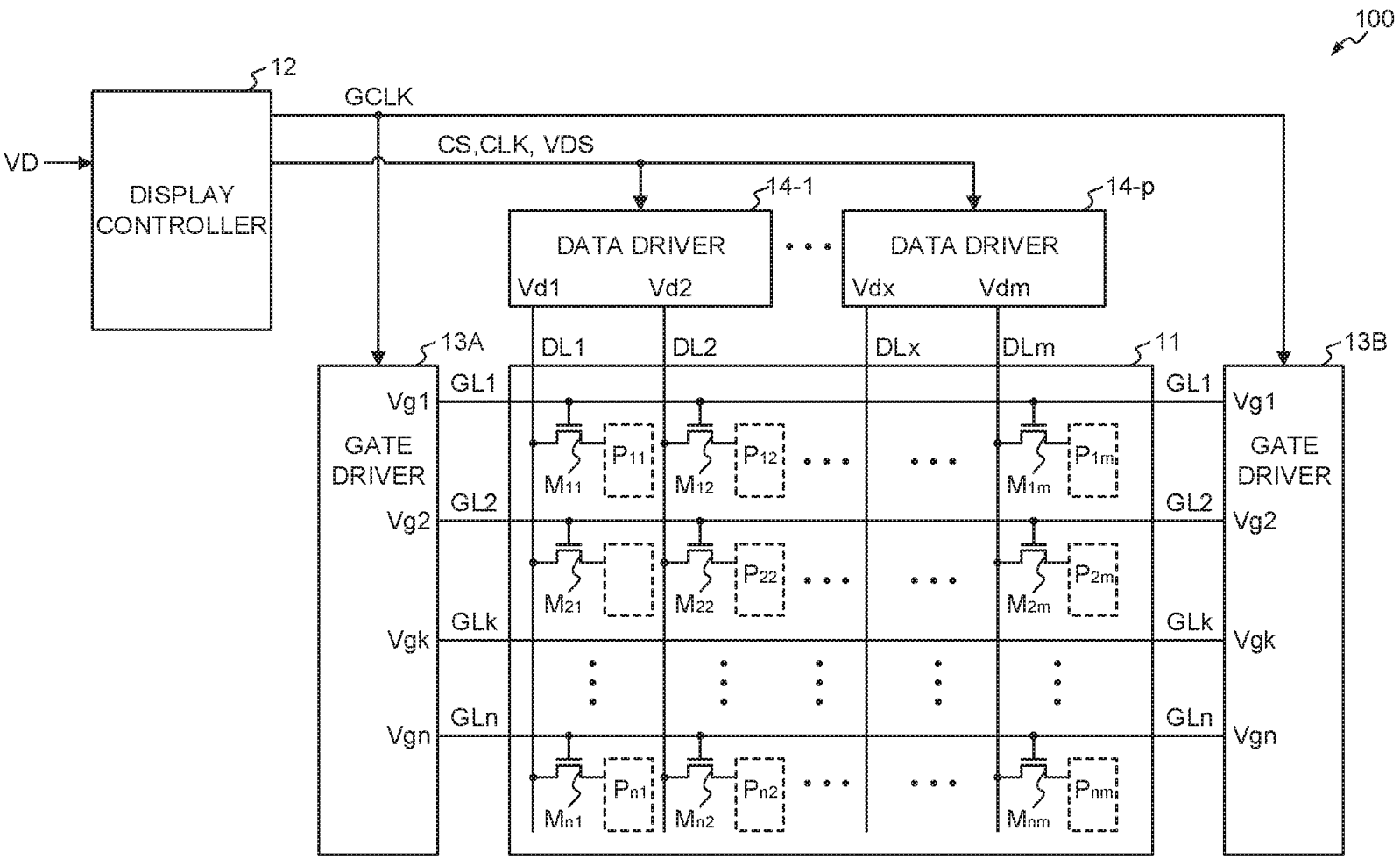
FIG. 1 is a block diagram illustrating a configuration of a display device according to the present invention.

Preferred embodiments of the present invention will be described in detail below. Note that same reference numerals are given to substantially identical or equivalent parts in the description in the following embodiments and the accompanying drawings.

Embodiment 1

FIG. 1 is a block diagram illustrating a configuration of a display device 100 according to the present invention. The display device 100 is a liquid crystal display device of an active matrix drive system. The display device 100 includes a display panel 11, a display controller 12, gate drivers 13A and 13B, and data drivers 14-1 to 14-*p*.

The display panel 11 is configured of a semiconductor substrate in which a plurality of pixel portions $P_{11}$ to $P_{nm}$ and pixel switches $M_{11}$ to $M_{nm}$ (n, m: natural numbers of two or more) are arranged in a matrix of n rows×m columns. The display panel 11 includes n gate lines GL1 to GLn as horizontal scanning lines and m data lines DL1 to DLm arranged to perpendicularly intersect therewith. The pixel portions $P_{11}$ to $P_{nm}$ and the pixel switches $M_{11}$ to $M_{nm}$ are disposed at intersecting portions between the gate lines GL1 to GLn and the data lines DL1 to DLm.

The display panel 11 is, for example, a display panel having a resolution of, what is called, 8K, specified by pixel count of 7680×4320. In the 8K display panel, n=4320 and m=7680, and thus, the number of the gate lines is 4320 and the number of the data lines is 7680.

The pixel switches $M_{11}$ to $M_{nm}$ are controlled to be turned on or off corresponding to gate signals Vg1 to Vgn supplied from the gate drivers 13A and 13B. The pixel portions $P_{11}$ to $P_{nm}$ receive supplies of gradation voltage signals Vd1 to Vdm corresponding to video data from the data drivers 14-1 to 14-*p*. When the respective pixel switches $M_{11}$ to $M_{nm}$ are on, the gradation voltage signals Vd1 to Vdm are supplied to the respective pixel electrodes of the pixel portions $P_{11}$ to $P_{nm}$ to charge the respective pixel electrodes. Corresponding to the gradation voltage signals Vd1 to Vdm in the respective pixel electrodes of the pixel portions $P_{11}$ to $P_{nm}$, luminance of the pixel portions $P_{11}$ to $P_{nm}$ are controlled, thus ensuring the display.

When the display device 100 is a liquid crystal display device, each of the pixel portions $P_{11}$ to $P_{nm}$ includes a transparent electrode connected to the data line via the pixel switch and a liquid crystal enclosed between the transparent electrode and a counter substrate. The counter substrate is provided to be opposed to the semiconductor substrate and includes one transparent electrode formed on the whole surface. Displaying is accomplished by transmittances of the liquid crystals change, which correspond to voltage differences between the gradation voltage signals Vd1 to Vdm supplied to the pixel portions $P_{11}$ to $P_{nm}$ and a counter substrate voltage, with respect to a backlight inside the display device.

The display controller 12 generates a video data signal VDS including a series of pixel data pieces PD that indicate luminance levels of the respective pixels in, for example, luminance gradation of 256 levels in 8 bits based on a video data VD. The video data signal VDS is configured as a video data signal serialized corresponding to the number of transmission paths for every predetermined number of the data lines.

In the embodiment, n/2 pixel data piece groups each of which is formed of m pixel data pieces PD serially continue to configure the video data signal VDS of one frame. By operations of the data drivers 14-1 to 14-*p*, the gradation voltage signals Vd1 to Vdm for which n×m pixel portions (that is, the pixel portions $P_{11}$ to $P_{nm}$) are to be supplied are generated based on m×(n/2) pieces of pixel data pieces PD.

The display controller 12 detects a horizontal synchronization signal from the video data VD and generates a clock signal CLK constant in a cycle of clock pulse (hereinafter referred to as a clock cycle) based on the horizontal synchronization signal. The clock signal CLK is, for example, formed in an embedded clock scheme. The display controller 12 generates a control signal CS including various kinds of settings. The display controller 12 supplies the video data signal VDS, the control signal CS, and the clock signal CLK, to the respective data drivers 14-1 to 14-*p* as integrated serial signals.

The display controller 12 supplies a gate clock signal GCLK to the gate drivers 13A and 13B disposed at both ends of the display panel 11.

The gate drivers 13A and 13B supply the gate signals Vg1 to Vgn to the gate lines GL1 to GLn based on the gate clock signal GCLK supplied from the display controller 12.

The data drivers 14-1 to 14-*p* are formed in a semiconductor integrated circuit (IC) chip. The data drivers 14-1 to 14-*p* sequentially retrieve the pixel data pieces PD one by one corresponding to each of horizontal scanning lines from the video data signal VDS. The data drivers 14-1 to 14-*p* generate the gradation voltage signals Vd1 to Vdm corresponding to luminance gradations indicated by the retrieved pixel data pieces and apply them to the data lines DL1 to DLm of the display panel 11.

The data drivers 14-1 to **14-*p* are disposed for every divided number of data lines into which the data lines DL1 to DLm are divided corresponding to the resolution of the display panel 11. For example, when the display panel 11** is an 8K panel, the data driver is configured of 24 data driver IC (that is, p=24) that each drive 966 data lines.

The data drivers 14-1 to **14-*p* each have outputs of channels (hereinafter referred to as ch) corresponding to the number of data lines to drive. In this embodiment, a description will be given of the example where each of the data drivers 14-1 to 14-*p*** has 966 channel outputs. Outputs of every 3 channels of 966 channels correspond to three pixels of R, G, B. For example, (3j+1) ch (j is an integer of $0 \leq j \leq 321$), such as 1 ch, 4 ch, and 7 ch, corresponds to the pixel R, 3j+2) ch, such as 2 ch, 5 ch, and 8 ch, corresponds to the pixel G, and (3j+3) ch, such as 3 ch, 6 ch, and 9 ch, corresponds to the pixel B.

The data drivers 14-1 to **14-*p* in this embodiment each have a function to generate the gradation voltage signals Vd1 to Vdm corresponding to the pixel data pieces for n rows of the horizontal scanning lines based on the pixel data pieces for (½) n rows of the horizontal scanning lines. In the following description, when a description is given of configurations and operations common to the data drivers 14-1 to 14-*p*, the description is given by referring one of the data drivers 14-1 to 14-*p* to simply as a "data driver 14**."

Figure 2:
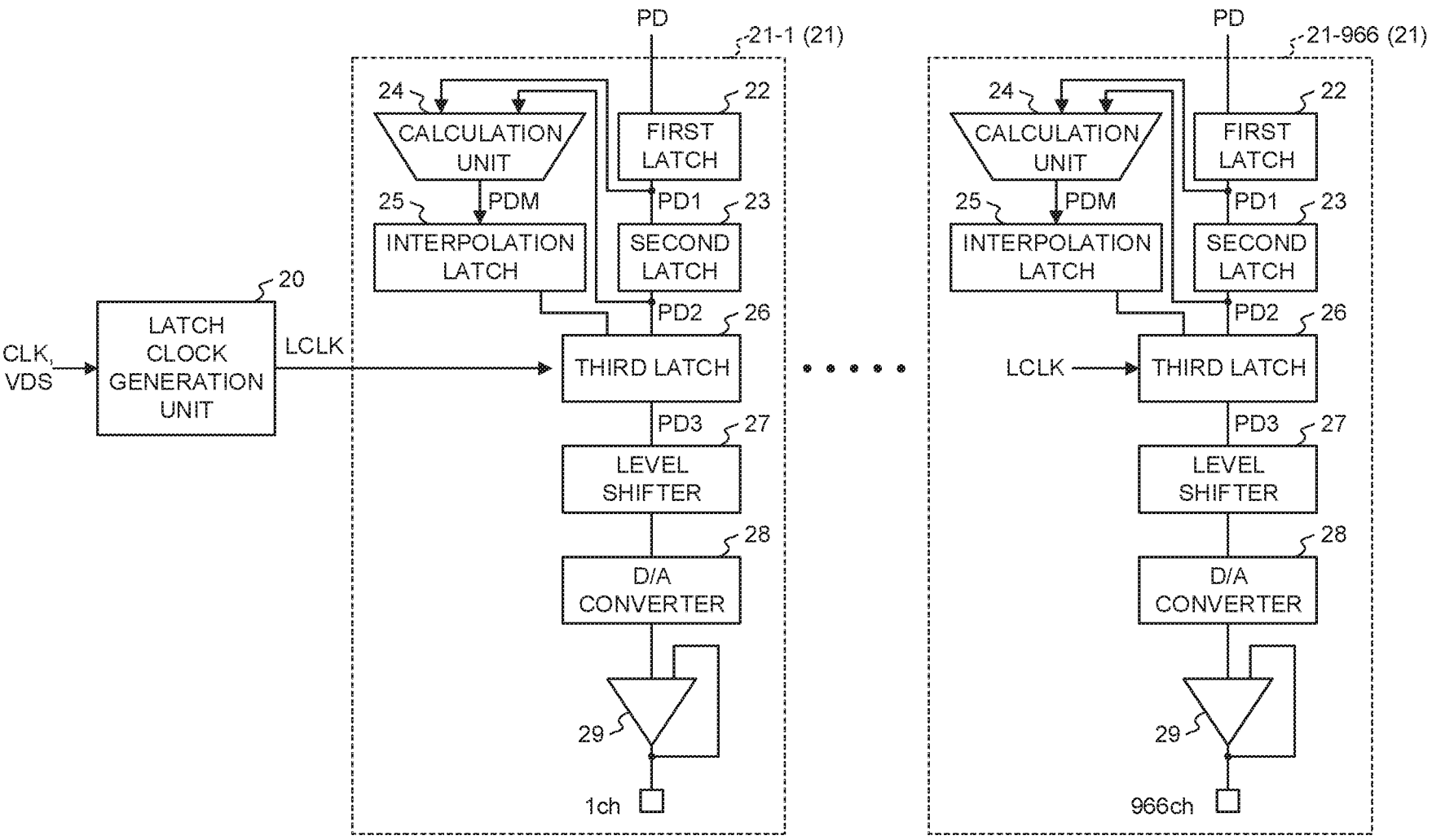
FIG. 2 is a block diagram illustrating a configuration of a data driver of Embodiment 1.

FIG. 2 is a block diagram illustrating an internal configuration of the data driver 14. The data driver 14 is configured of a latch clock generation unit 20 and 966 output circuits 21 that perform output of 1 ch to 966 ch. FIG. 2 extracts an output circuit 21-1 that performs output of the 1 ch and an output circuit 21-966 that performs output of the 966 ch.

The latch clock generation unit 20 generates a latch clock signal LCLK based on the clock signal CLK and the video data signal VDS supplied from the display controller 12. The latch clock generation unit 20 supplies the generated latch clock signal LCLK to each of the output circuits 21-1 to 21-966.

Figure 3:
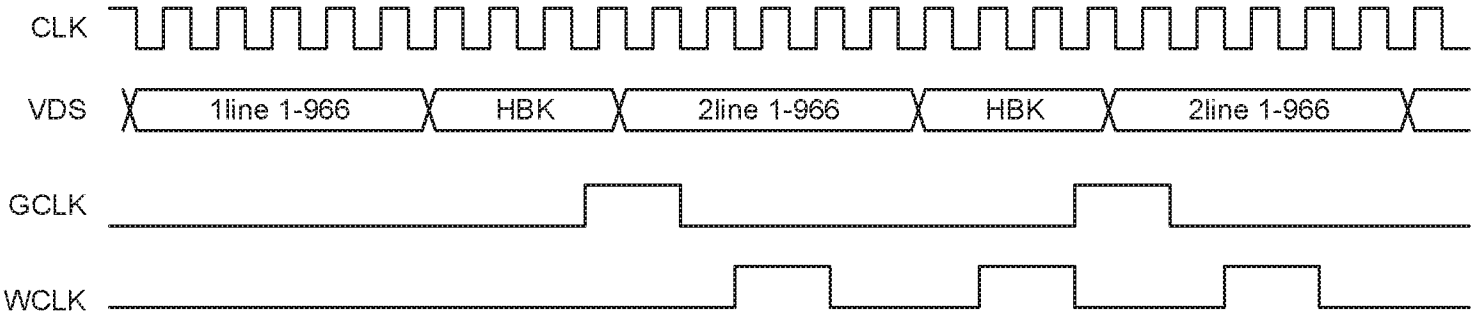
FIG. 3 is a timing chart illustrating a latch clock signal.

FIG. 3 is a timing chart schematically illustrating changes of signal levels of the latch clock signal LCLK. Here, for simplified description, a length of one horizontal scanning period of the video data signal VDS is shortened and illustrated.

The gate clock signal CLK is a signal that rises at a timing corresponding to a horizontal synchronization signal HBK of the video data signal VDS. The latch clock signal LCLK is a signal that has a frequency double of that of the gate clock signal GCLK and rises with delay after rise in the gate clock signal GCLK by a period corresponding to 480 channel video data in the video data signal VDS.

Referring to FIG. 2 again, the output circuit 21-1 includes a first latch 22, a second latch 23, a calculation unit 24, an interpolation latch 25, a third latch 26, a level shifter 27, a D/A converter 28, and an output amplifier 29.

The first latch 22 retrieves the pixel data piece PD from the video data signal VDS supplied from the display controller 12. As described above, the video data signal VDS is transmitted from the display controller 12 to the data driver 14 as a series of the pixel data piece group formed of pixel data pieces PD for every 966 channels of 1 line. The first latch 22 in an output circuit of each channel retrieves the pixel data piece PD by each 1 channel of line. The first latch 22 holds the retrieved pixel data piece PD as a first pixel data piece PD1.

The second latch 23 retrieves the first pixel data piece PD1 from the first latch 22 at a timing at which all the first latches 22 of the output circuits 21-1 to 21-966 retrieve the pixel data pieces PD. This causes the respective second latches 23 of the output circuits 21-1 to 21-966 to concurrently retrieve the pixel data pieces of one horizontal scanning line. The second latch 23 holds the retrieved pixel data piece as a second pixel data piece PD2.

The calculation unit 24 obtains the first pixel data piece PD1 from the first latch 22 and obtains the second pixel data piece PD2 from the second latch 23.

As described above, the first latch 22 of each channel sequentially retrieves the pixel data piece PD from the video data signal VDS, whereas the second latch 23 of each channel retrieves the first pixel data piece PD1 at a common timing. In view of this, the pixel data pieces PD different by one horizontal scanning period of the video data signal VDS are supplied to the calculation unit 24 as the first pixel data piece PD1 and the second pixel data piece PD2.

The video data signal VDS in this embodiment is configured of a series of pixel data piece group of n/2 line. They correspond to video data of every other one horizontal scanning line (that is, video data of every other gate line) of the display panel 11. Accordingly, the second pixel data piece PD2 supplied from the second latch 23 to the calculation unit 24 is a pixel data piece corresponding to a pixel portion on the kth gate line GLk (k is a natural number). The first pixel data piece PD1 supplied from the first latch 22 to the calculation unit 24 is a pixel data piece corresponding to a pixel portion on (k+2)th gate line GL (k+2).

The calculation unit 24 performs a linear interpolation on the first pixel data piece PD1 obtained from the first latch 22 and the second pixel data piece PD2 obtained from the second latch 23 so as to generate interpolation data PDM. Specifically, the interpolation data PDM is PDM=(PD1+PD2)/2. As described above, the first pixel data piece PD1 obtained from the first latch 22 is a pixel data piece corresponding to a pixel portion on the (k+2)th gate line GL (k+2). The second pixel data piece PD2 obtained from the second latch 23 is a pixel data piece corresponding to a pixel portion on the kth gate line GLk. As a result, the interpolation data PDM is a pixel data piece corresponding to a pixel portion on the (k+1) gate line GL (k+1) positioned between them.

The interpolation latch 25 retrieves the interpolation data PDM output from the calculation unit 24. The respective interpolation latches 25 of the output circuits 21-1 to 21-966 retrieve the interpolation data pieces PDM at a common timing synchronized with the horizontal synchronization signal HBK of the video data signal VDS. This causes the interpolation data pieces PDM of one horizontal scanning line to be taken in the interpolation latches 25 of the output circuits 21-1 to 21-966.

The calculation unit 24 and the interpolation latch 25 are function blocks that perform generation, acquisition and retention of the interpolation data PDM, and configure an interpolation data generating unit as a unit.

The third latch 26 alternately performs a retrieval of the second pixel data piece PD2 from the second latch 23 and a retrieval of the interpolation data PDM from the interpolation latch 25 based on a clock timing of the latch clock signal LCLK. The third latch 26 sequentially outputs the retrieved second pixel data piece PD2 and interpolation data PDM as a third pixel data piece PD3.

As described above, since the interpolation data PDM is a pixel data piece corresponding to a pixel portion on the (k+1) gate line GL (k+1), the third latch 26 outputs the pixel data pieces corresponding to the pixel portions on the respective gate lines in order of the kth, the (k+1), and the (k+2).

The level shifter 27 performs a level shift process that increases a signal amplitude on the third pixel data piece PD3 output from the third latch 26, and supplies it to the D/A converter 28.

The D/A converter 28 selects the gradation voltage corresponding to the pixel data piece output from the level shifter 27. As a result, the pixel data piece which is digital data is converted into a gradation voltage signal which is analog data (that is, digital-analog conversion is performed). The D/A converter 28 then supplies the gradation voltage signal to the output amplifier 29.

The output amplifier 29 amplifies the gradation voltage signal selected by the D/A converter 28 and outputs it to the data line.

Figure 4:
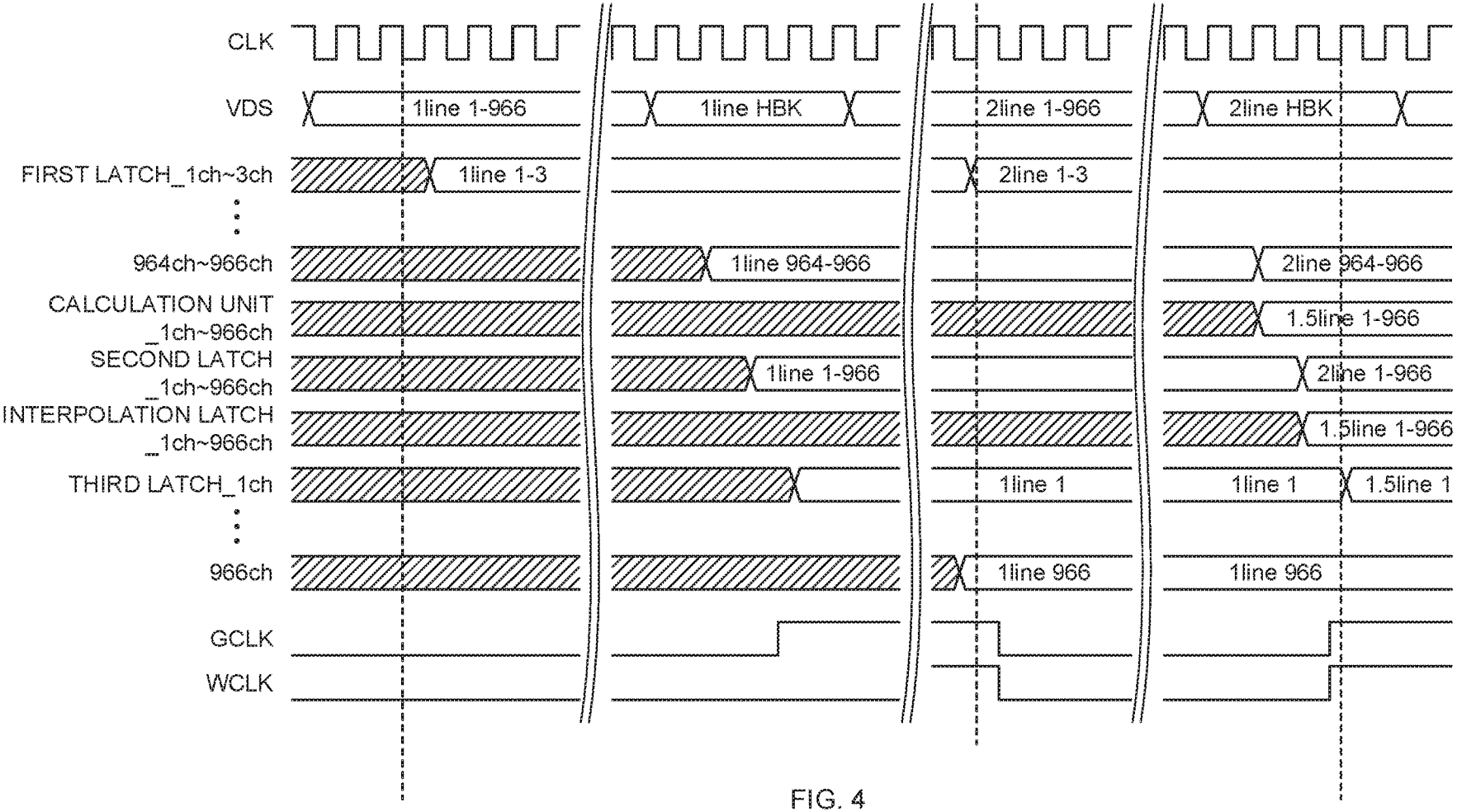
FIG. 4 is a timing chart illustrating operations of respective portions of the data driver.
Figure 5:
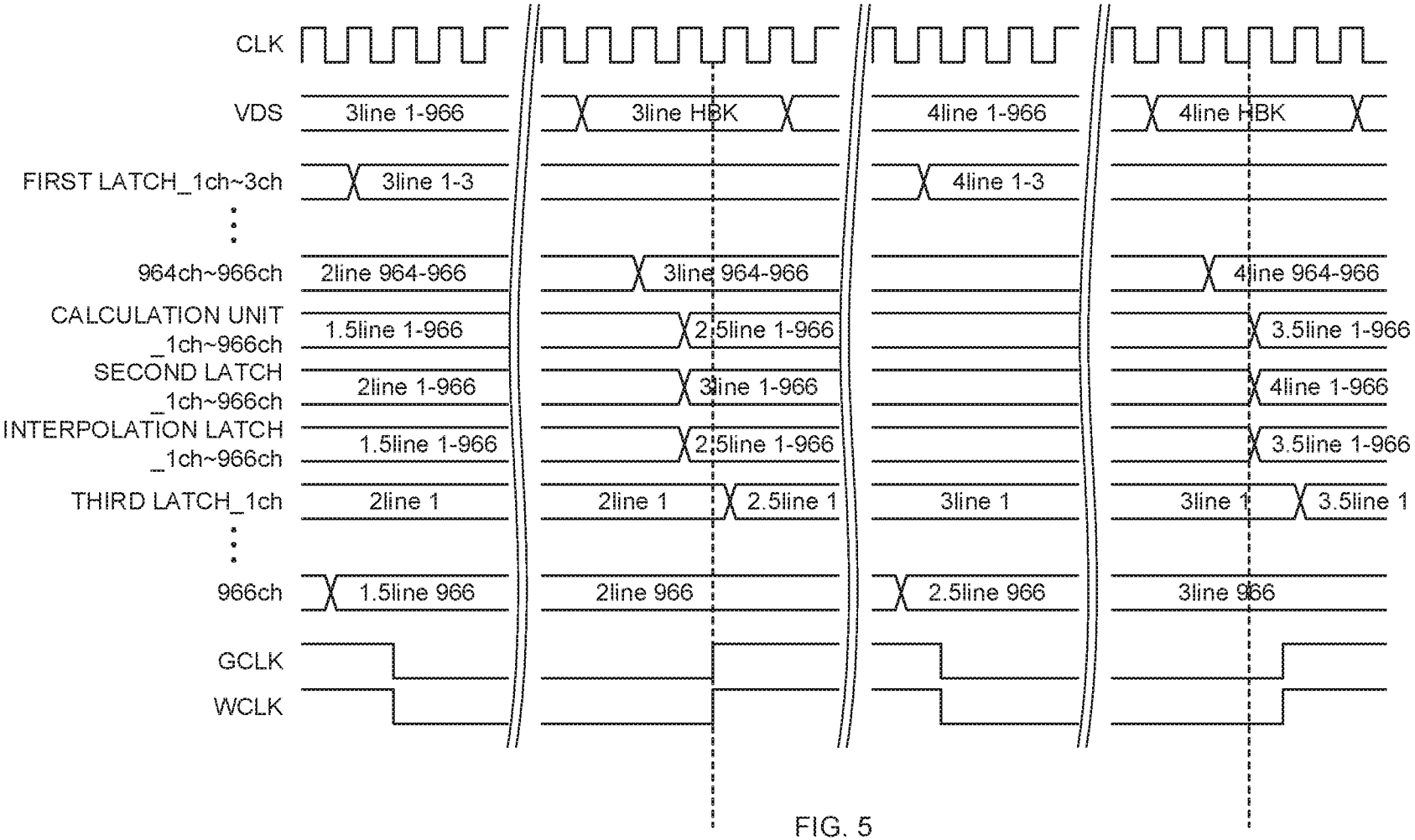
FIG. 5 is a timing chart illustrating operations of respective portions of the data driver.

Next, a description will be given of an operation of the data driver 14 of this embodiment. FIG. 4 and FIG. 5 are timing charts illustrating retrieval timings of the pixel data piece PD and the interpolation data PDM by the first latch 22, the second latch 23, the calculation unit 24, the interpolation latch 25, and the third latch 26 in the data driver. FIG. 5 is a timing chart illustrating the sequel of the timing chart in FIG. 4.

The first latch 22 of the output circuit 21-1 extracts and retrieves a pixel data piece PD corresponding to the 1 ch among the first pixel data piece group (illustrated as "1 line 1-966" in FIG. 4) from a series of the pixel data piece group of each one horizontal scanning line of the video data signal VDS transmitted from the display controller 12. The first latches 22 of the neighboring output circuits 21-2 and 21-3 also similarly retrieve a pixel data piece PD corresponding to the 2 ch among the first pixel data piece group and a pixel data piece PD corresponding to the 3 ch among the first pixel data piece group, respectively. The 1 ch pixel data piece PD, the 2 ch pixel data piece PD, and the 3 ch pixel data piece PD are pixel data pieces responsible for the pixel R, the pixel G, and the pixel B, respectively.

Similarly in the following, the respective first latches 22 of the output circuits 21-4 to 21-966 sequentially retrieve the pixel data pieces PD of the corresponding channels. This causes the pixel data pieces PD for 966 channels of 1 line to be taken in the first latches 22 of the output circuits 21-1 to 21-966. The first latch 22 holds the retrieved pixel data piece PD as the first pixel data piece PD1.

The first latch 22 retrieves the pixel data piece PD of the corresponding channel of the second pixel data piece group (illustrated as "2 line 1-966" in FIG. 4) when the retrieval and the output of the pixel data piece PD of the corresponding channel of the first pixel data piece group are completed. The first latch 22 sequentially retrieves the pixel data piece PD after the second pixel data piece group.

The first pixel data piece group is a pixel data piece group to be supplied to the pixel portions on the first gate line GL1. The second pixel data piece group, the third pixel data piece group (illustrated as "3 line 1-966" in FIG. 5), and the fourth pixel data piece group (illustrated as "4 line 1-966" in FIG. 5) are pixel data piece groups corresponding to the third gate line GL3, the fifth gate line GL5, and the seventh gate line GL7, respectively.

The second latch 23 retrieves the first pixel data piece PD1 from the first latch 22. The retrieval of the first pixel data pieces PD1 by the second latches 23 of the output circuits 21-1 to 21-966 is performed based on a timing when all the first latches 22 of the output circuit 21-1 to the output circuit 21-966 retrieve the pixel data pieces PD. The second latch 23 holds the retrieved first pixel data piece PD1 as the second pixel data piece PD2. The second pixel data piece PD2 output from the second latch 23 is supplied to the third latch 26 and the calculation unit 24.

The calculation unit 24 obtains the first pixel data piece PD1 and the second pixel data piece PD2 from the first latch 22 and the second latch 23, respectively. The first pixel data piece PD1 and the second pixel data piece PD2 are pixel data pieces to be supplied to the same pixel portions and are different by one horizontal scanning line. For example, the calculation unit 24 is supplied with the pixel data piece PD of the first pixel data piece group (that is, "1 line 1-966") output from the second latch 23 and the pixel data piece PD of the second pixel data piece group (that is, "2 line 1-966") output from the first latch 22.

The calculation unit 24 performs the interpolation operation on the pixel data piece PD of the first pixel data piece group and the pixel data piece PD of the second pixel data piece group to generate interpolation data PDM corresponding to a pixel data piece PD of a 1.5th pixel data piece group (illustrated as "1.5 line 1-966" in FIG. 4 and FIG. 5). The 1.5th pixel data piece group is a pixel data piece group to be supplied to the pixel portions on the second gate line GL2. The calculation unit 24 outputs the generated interpolation data PDM.

Similarly in the following, the calculation unit 24 performs an operation on the pixel data piece PD of the second pixel data piece group output from the second latch 23 and the pixel data piece PD of the third pixel data piece group output from the first latch 22. By such an operation, the calculation unit 24 generates interpolation data PDM corresponding to a pixel data piece of a 2.5th pixel data piece group (illustrated as "2.5 line 1-966" in FIG. 5). The 2.5th pixel data piece group is a pixel data piece group to be supplied to the pixel portions on the fourth gate line GL4.

The interpolation latch 25 retrieves the interpolation data PDM output from the calculation unit 24 and outputs it at a timing synchronized with one horizontal period of the video data signal VDS.

The respective third latches 26 of the output circuits 21-1 to 21-966 alternately retrieve the pixel data piece PD (that is, the second pixel data piece PD2) output from the second latch 23 and the interpolation data PDM output from the interpolation latch 25 based on the clock timing of the latch clock signal LCLK. For example, the third latch 26 of the output circuit 21-1 alternately retrieves the pixel data piece PD corresponding to the 1 ch of the first pixel data piece group output from the second latch 23 and the interpolation data PDM output from the interpolation latch 25. The interpolation data PDM output from the interpolation latch 25 is the pixel data piece corresponding to the 1 ch of the 1.5th pixel data piece group. As a result, the third latch 26 retrieves the pixel data piece of the same channel of the 1.5th pixel data piece group subsequently to the pixel data piece PD of the first pixel data piece group.

Similarly in the following, the third latch 26 retrieves the pixel data piece PD for each channel in order of the second pixel data piece group, the 2.5th pixel data piece group, the third pixel data piece group, and so on. The third latch 26 sequentially outputs the retrieved pixel data piece PD as the third pixel data piece PD3. The output third pixel data piece PD3 is output as the gradation voltage signal through the level shift process by the level shifter 27, the digital analog conversion process by the D/A converter 28, and the amplifying process by the output amplifier 29. As a result, the gradation voltage signals each corresponding to the first gate line GL1, the second gate line GL2, and the third gate line GL3 . . . are output.

As described above, the data drivers 14-1 to **14-*p* of this embodiment each include the calculation unit 24 in the output circuits 21-1 to 21-966 corresponding to the respective channel as the interpolation data. The calculation unit 24 generates the pixel data piece corresponding to the pixel portion on the (k+1)th gate line GL (k+1) based on the pixel data piece corresponding to the pixel portion on the kth gate line GLk output from the second latch 23 and the pixel data piece corresponding to the pixel portion on the (k+2)th gate line GL (k+2) output from the first latch 22. The third latch 26 alternately retrieves the pixel data piece PD output from the second latch 23 and the interpolation data PDM generated by the calculation unit 24** and sequentially outputs them at a timing based on the latch clock signal LCLK having the clock cycle corresponding to a length ½ of one horizontal period of the video data signal VDS.

With such a configuration, image display of n lines is possible based on the pixel data piece PD of n/2 lines. Accordingly, for example, when content with video standard of 4K is displayed on the display panel supporting 8K, the pixel data in the horizontal scanning line direction (that is, the gate line direction) can be interpolated, thus ensuring the displaying.

With the data driver of this embodiment, the displaying can be ensured by interpolating the pixels of the video signal without adding an external device and the like. Accordingly, the video displaying can be ensured by interpolating the pixels while reducing an increase in scale of the device.

Since it is not necessary to perform a frequency conversion and the like on the video data signal to be supplied to the data driver, and no increase of the information volume associated with the frequency conversion and the like is generated, it is possible to perform the video display by interpolating the pixel while reducing the degradation of the communication waveform.

Embodiment 2

Next, Embodiment 2 of the present invention will be described. A data driver of this embodiment is different from the data driver of Embodiment 1 in that the pixel data in a data line direction (that is, a channel direction) is interpolated in addition to the interpolation of the pixel data in a scanning line direction (that is, a line direction).

Figure 6:
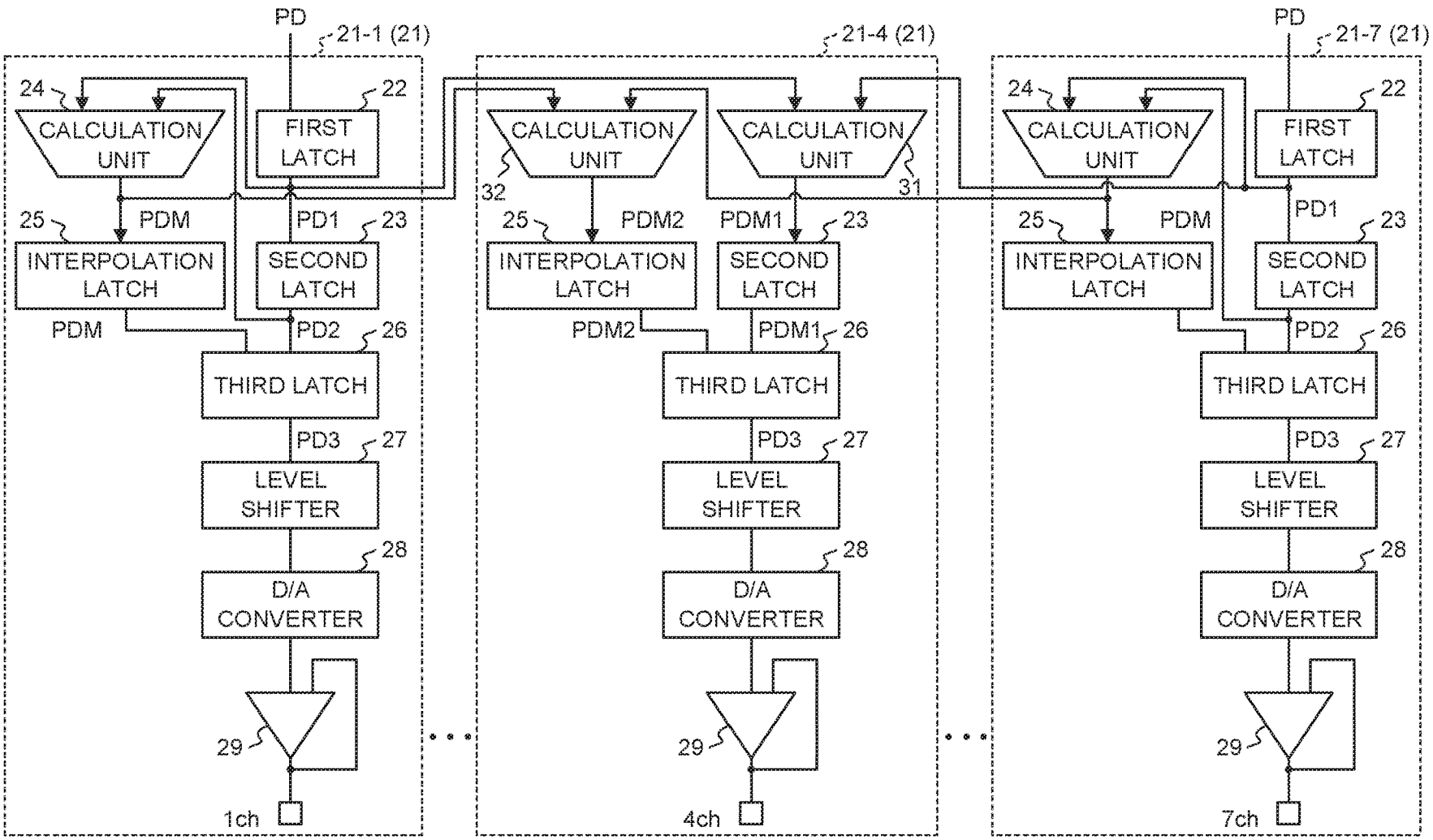
FIG. 6 is a block diagram illustrating a configuration of a data driver of Embodiment 2.

FIG. 6 is a block diagram illustrating a part of an internal configuration of the data driver 14 of this embodiment. Here, the output circuit 21-1 corresponding to the 1 ch, the output circuit 21-4 corresponding to the 4 ch, and the output circuit 21-7 corresponding to the 7 ch are extracted and illustrated among the output circuits 21-1 to 21-966 included in the data driver 14. They are corresponding to the channels of (3j+1) ch (j is an integer of $0 \leq j \leq 321$) described in Embodiment 1, and are output circuits that output the gradation voltage signals corresponding to the pixel R.

The output circuits 21-1 and 21-7 have configurations similar to that of the output circuit 21-1 in Embodiment 1, retrieve the pixel data piece PD from the video data signal VDS, and output the gradation voltage signals corresponding to them.

Meanwhile, the output circuit 21-4 generates the gradation voltage signals based on the data output from the output circuits 21-1 and 21-7, instead of retrieving the pixel data piece PD from the video data signal VDS. The output circuit 21-4 includes a calculation unit 31 and a calculation unit 32.

The calculation unit 31 performs the linear interpolation on the first pixel data piece PD1 output from the first latch 22 of the output circuit 21-1 and the first pixel data piece PD1 output from the first latch 22 of the output circuit 21-7 to generate an interpolation data PDM1. For example, when the first pixel data output from the first latch 22 of the output circuit 21-1 is PD1 (1) and the pixel data output from the first latch 22 of the output circuit 21-7 is PD1 (7), the interpolation data PDM1 is PDM1=(PD1 (1)+PD1 (7))/2.

The calculation unit 32 performs the linear interpolation on the interpolation data PDM output from the calculation unit 24 of the output circuit 21-1 and the interpolation data PDM output from the calculation unit 24 of the output circuit 21-7 so as to generate an interpolation data PDM2. For example, when the interpolation data output from the calculation unit 24 of the output circuit 21-1 is PDM (1) and the pixel data output from the calculation unit 24 of the output circuit 21-7 is PDM (7), the interpolation data PDM2=(PDM (1)+PDM (7))/2.

The second latch 23 of the output circuit 21-4 retrieves the interpolation data PDM1 output from the calculation unit 31. The second latch 23 outputs the retrieved interpolation data PDM1.

The interpolation latch 25 of the output circuit 21-4 retrieves the interpolation data PDM2 output from the calculation unit 32 and outputs it at a timing synchronized with one horizontal period of the video data signal VDS.

The third latch 26 of the output circuit 21-4 alternately retrieves the interpolation data PDM1 output from the second latch 23 and the interpolation data PDM2 output from the interpolation latch 25 based on the clock timing of the latch clock signal LCLK by one line. The third latch 26 sequentially outputs the retrieved interpolation data PDM1 and interpolation data PDM2 as the third pixel data piece PD3.

The interpolation data PDM1 is interpolation data obtained by performing the linear interpolation on the pixel data pieces PD1 output from the respective first latches 22 of the output circuits 21-1 and 21-7. Meanwhile, the interpolation data PDM2 is interpolation data obtained by performing the linear interpolation on the interpolation data PDM output from the respective calculation units 24 of the output circuit 21-1 and 21-7. Accordingly, the third latch 26 outputs the third pixel data pieces PD3 corresponding to the pixel portions on the respective gate lines in order of the kth gate line GLk, the (k+1)th gate line GL (k+1), and the (k+2)th gate line GL (k+2).

Configurations and operations of the level shifter 27, the D/A converter 28, and the output amplifier 29 are similar to those of Embodiment 1. That is, the output third pixel data piece PD3 is output as the gradation voltage signal through the level shift process by the level shifter 27, the digital analog conversion process by the D/A converter 28, and the amplifying process by the output amplifier 29.

As described above, in the data driver 14 of this embodiment, the output circuit 21-4 performs the interpolation operation based on the pixel data piece PD retrieved by the output circuit 21-1 and the pixel data piece PD retrieved by the output circuit 21-7 so as to generate the interpolation data PDM1. The output circuit 21-4 also performs the interpolation operation based on the interpolation data PDM generated by the output circuit 21-1 and the interpolation data PDM generated by the output circuit 21-7 to generate the interpolation data PDM2. Accordingly, the output circuit 21-4 can generate the gradation voltage signal without retrieving the pixel data piece PD from the video data signal VDS.

In the data driver 14 of this embodiment, the output circuits having a configuration similar to that of the output circuit 21-4 are alternately disposed in the output circuit group that outputs the gradation voltage signals corresponding to the pixels of the same color. For example, in the output circuit group that corresponds to (3j+1) ch that outputs the gradation voltage signal corresponding to the pixel R, the output circuit corresponding to channel of 6t−2 (t is a natural number) has a configuration similar to that of the output circuit 21-4. Similarly, in the output circuit group corresponding to (3j+2) ch that outputs the gradation voltage signal corresponding to the pixel G, the output circuit corresponding to channel of 6t−1 (t is a natural number) has a configuration similar to that of the output circuit 21-4. In the output circuit group corresponding to (3j+3) ch that outputs the gradation voltage signal corresponding to the pixel B, the output circuit corresponding to channel of 6t (t is a natural number) has a configuration similar to that of the output circuit 21-4.

With such a configuration, the interpolation of the pixel data for each channel is possible in addition to the interpolation of the pixel data for each line similarly to Embodiment 1. That is, with the data driver 14 of this embodiment, image displaying for Q channels is possible based on the pixel data piece PD for Q/2 channels. Accordingly, for example, when content having a video standard of 4K is displayed on a display panel supporting 8K, it is possible to interpolate the pixel data in both the line direction and the channel direction, thus ensuring the displaying.

A configuration that allows to switch between an output mode that interpolate the pixel data as described above and an output mode that does not interpolate the pixel data may be added to the data driver 14 of this embodiment.

Figure 7:
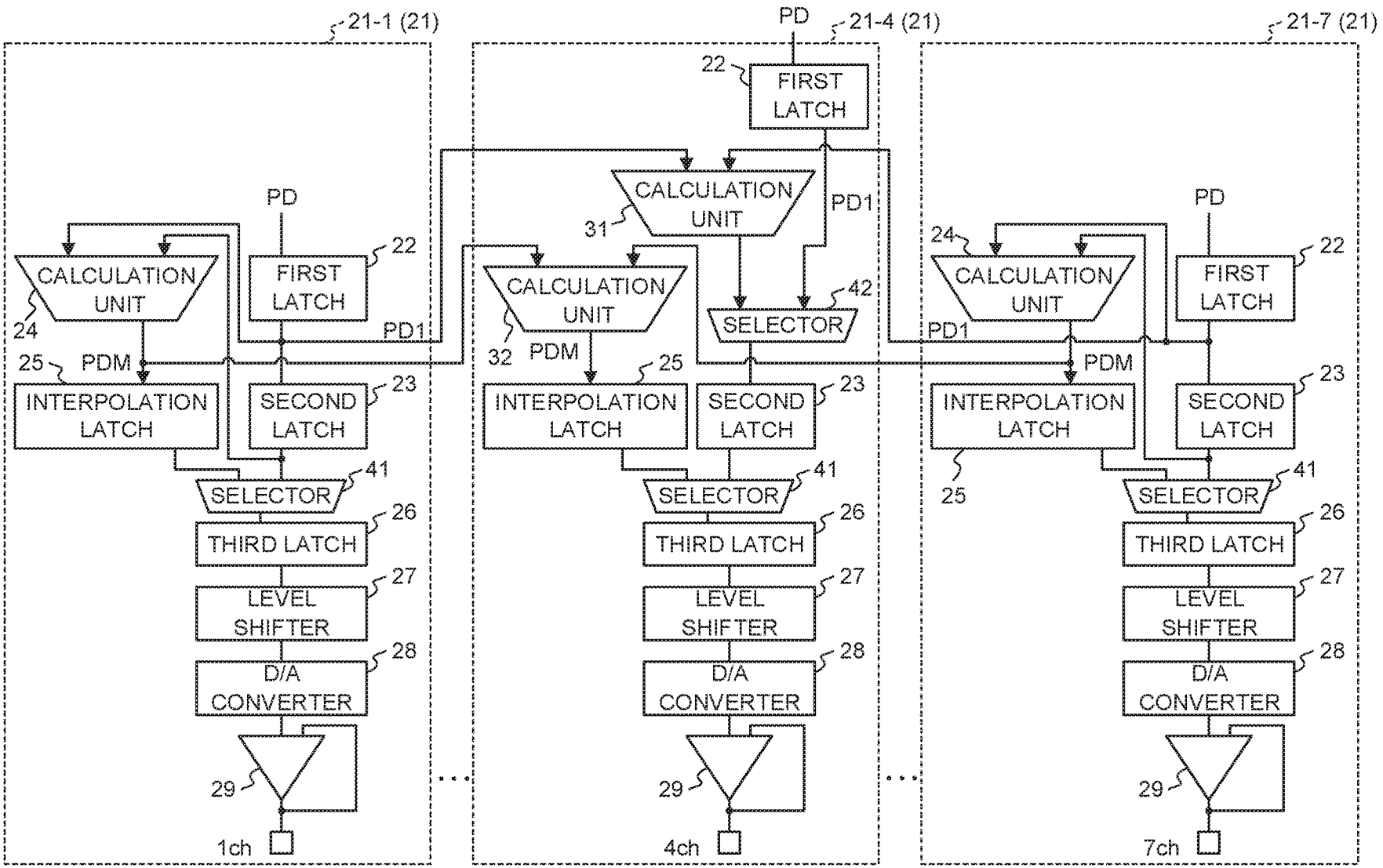
FIG. 7 is a block diagram illustrating a configuration of a data driver of a modification.

FIG. 7 is a block diagram illustrating a part of an internal configuration of the data driver 14 according to such a modification. Each of the output circuits 21-1, 21-4, and 21-7 has a selector 41 disposed between the second latch 23 and interpolation latch 25 and the third latch 26. The output circuit 21-4 has a selector 42 disposed at a position which is between the first latch 22 and the second latch 23 and is also between the calculation unit 31 and the second latch 23.

The selector 41 selectively switches whether to supply the interpolation data PDM output from the interpolation latch 25 to the third latch 26 or not. The switching of the selector 41 is performed, for example, based on the supply of the control signal CS from the display controller 12.

For example, when it is set to a first output mode that outputs the gradation voltage signal based on the interpolation of the pixel data for each horizontal scanning line, the selector 41 supplies the interpolation data PDM output from the interpolation latch 25 to the third latch 26. This outputs the gradation voltage signal based on the interpolation of the pixel data for each line as indicated in the above-described Embodiment 1.

Meanwhile, when it is set to a second output mode that does not output the gradation voltage signal based on the interpolation of the pixel data for each horizontal scanning line, the selector 41 switches the output to stop supplying the interpolation data PDM output from the interpolation latch 25 to the third latch. This supplies only the pixel data piece PD2 output from the second latch 23 to the third latch 26.

The selector 42 is a selector that selectively switches which one of the first pixel data piece PD1 output from the first latch 22 or the interpolation data PDM1 output from the calculation unit 31 to be supplied to the second latch 23. The switching of the selector 42 is, for example, performed based on the supply of the control signal CS from the display controller 12.

For example, when it is set to a third output mode that outputs the gradation voltage signal based on the interpolation of the pixel data for each channel, the selector 42 switches the output to supply the interpolation data PDM1 output from the calculation unit 31 to the second latch 23. This causes output of the gradation voltage signal based on the interpolation of the pixel data for each channel as indicated in this embodiment.

Meanwhile, when it is set to a fourth output mode that does not output the gradation voltage signal based on the interpolation of the pixel data for each channel, the selector 42 switches the output to supply the first pixel data piece PD1 output from the first latch 22 to the second latch 23. As a result, the first pixel data piece PD1 based on the pixel data piece PD retrieved by the first latch 22 from the video data signal VDS is supplied to the second latch 23, similarly to those of the output circuits 21-1 and 21-7 that do not include the calculation unit 31. Accordingly, the gradation voltage signal is output.

One of the first output mode and the second output mode, and one of the third output mode and the fourth output mode can be appropriately combined. For example, combining the first output mode and the third output mode ensures interpolate the pixel data both in the line direction and the channel direction. Combining the first output mode and the fourth output mode ensures interpolating the pixel data only in the line direction. Combining the second output mode and the third output mode ensures interpolating the pixel data only in the channel direction. Combining the second output mode and the fourth output mode ensures inhibiting the output of the gradation voltage signal based on the interpolation of the pixel data.

Since such a configuration ensures switching between the output mode that interpolates the pixel data and the output mode that does not interpolate the pixel data, for example, when the display is performed using a display panel supporting the 8K, it is possible to switch a display format according to whether the supplied video data signal is based on the video standard of 8K or based on the video standard of 4K.

The present invention is not limited to the above-described embodiments. For example, in the above-described embodiments, the configuration that interpolates the pixel data has been described with the exemplary case where the content with video standard of 4K is displayed on the 8K display panel. However, the present invention is not limited to this, but is applicable to various situations where the interpolation of pixel data is necessary. For example, the display driver of the present invention may be used for a display driver to display content of an ordinary high-definition broadcast on a 4K display panel.

In the above-described embodiments, the description has been made for the case where the display device 100 is a liquid crystal display device, but unlike this, the display device 100 may be an organic electro luminescence (EL) display device.

What is claimed is:

1. A display driver coupled to a display panel, wherein the display panel includes m data lines and n gate lines (m and n are integers of two or more), and m×n pixel portions disposed in a matrix at respective intersecting portions between the m data lines and the n gate lines, and the display driver receives a video data signal for one frame and generates a gradation voltage signal, the video data signal being formed of continuous n/2 pieces of pixel data piece groups each of which is formed of m pixel data pieces, the gradation voltage signal being supplied to each of the m×n pixel portions based on the video data signal, wherein the display driver comprises m output circuits disposed corresponding to the m data lines, the m output circuits outputting the gradation voltage signal to each of the m data lines, wherein each of the m output circuits includes:

a first latch that sequentially retrieves the pixel data piece from the pixel data piece group for each one horizontal scanning period of the video data signal, the first latch holding the pixel data piece as a first pixel data piece;

a second latch that retrieves the first pixel data piece from the first latch at a timing when the retrieval of the pixel data piece by the first latch is completed, the second latch holding the first pixel data piece as a second pixel data piece;

an interpolation data generating unit that obtains the first pixel data piece from the first latch and obtains the second pixel data piece from the second latch so as to generate an interpolation data piece by interpolating between the first pixel data piece and the second pixel data piece;

a third latch that alternately retrieves the second pixel data piece from the second latch and the interpolation data piece from the interpolation data generating unit, the third latch sequentially outputting the second pixel data piece and the interpolation data piece alternately as a third pixel data piece; and a gradation voltage output unit that outputs a gradation voltage signal corresponding to the third pixel data piece based on the third pixel data piece output from the third latch.

2. The display driver according to claim 1, wherein the third latch performs the retrieval of the second pixel data piece and the retrieval of the interpolation data piece at a cycle of ½ of the one horizontal scanning period of the video data signal.

3. The display driver according to claim 1, wherein the interpolation data generating unit obtains a pixel data piece corresponding to a pixel portion on kth gate line (k is a natural number of n or less) as the second pixel data piece and obtains a pixel data piece corresponding to a pixel portion on (k+2)th gate line as the first pixel data piece among the n gate lines of the display panel so as to generate the interpolation data piece as pixel data corresponding to pixel portions on (k+1)th gate line.

4. The display driver according to claim 1, wherein the interpolation data generating unit generates the interpolation data piece by performing an operation of linear interpolation on the first pixel data piece and the second pixel data piece.

5. A display device comprising:

a display panel including m data lines, n gate lines (m and n are integers of two or more), and m×n pixel portions disposed in a matrix at respective intersecting portions between the m data lines and the n gate lines;

a gate driver that supplies a scan signal that controls to turn on a pixel switch in a selection period corresponding to a pulse width to the n gate lines;

a data driver that receives a video data signal for one frame, and generates a gradation voltage signal, the video data signal being formed of continuous n/2 pieces of pixel data piece groups each of which is formed of m pixel data pieces, the gradation voltage signal being supplied to each of the m×n pixel portions based on the video data signal; and a display controller that supplies the video data signal to the data driver, wherein the data driver includes m output circuits disposed corresponding to the m data lines, the m output circuits outputting the gradation voltage signal to each of the m data lines, and each of the m output circuits includes:

a first latch that sequentially retrieves the pixel data piece from the pixel data piece group for each one horizontal scanning period of the video data signal, the first latch holding the pixel data piece as a first pixel data piece;

a second latch that retrieves the first pixel data piece from the first latch at a timing when the retrieval of the pixel data piece by the first latch is completed, the second latch holding the first pixel data piece as a second pixel data piece;

an interpolation data generating unit that obtains the first pixel data piece from the first latch and obtains the second pixel data piece from the second latch so as to generate an interpolation data piece by interpolating between the first pixel data piece and the second pixel data piece;

a third latch that alternately performs a retrieval of the second pixel data piece from the second latch and a retrieval of the interpolation data piece from the interpolation data generating unit, the third latch sequentially outputting the second pixel data piece and the interpolation data piece as a third pixel data piece; and a gradation voltage output unit that outputs a gradation voltage signal corresponding to the third pixel data piece based on the third pixel data piece output from the third latch.

* * * * *